US006061868A

United States Patent [19]

Moritsch et al.

[11] Patent Number: 6,061,868

[45] Date of Patent: May 16, 2000

[54] TRAVELING FLOOR CLEANING APPLIANCE

[75] Inventors: Erich Moritsch, Plochingen; Gilles Troff, Stuttgart, both of Germany

[73] Assignee: Alfred Kärcher GmbH & Co., Winnenden, Germany

[21] Appl. No.: 09/299,834

[22] Filed: Apr. 26, 1999

Related U.S. Application Data

[63] Continuation of application No. PCT/EP97/05885, Oct. 24, 1997.

[30] Foreign Application Priority Data

Oct. 26, 1996 [DE] Germany ..... 196 44 570

[51] Int. Cl.[7] ..... A47L 11/30

[52] U.S. Cl. ..... 15/320; 15/339; 15/353; 15/385

[58] Field of Search ..... 15/320, 339, 353, 15/363, 385

[56] References Cited

U.S. PATENT DOCUMENTS

| | | | |
|---|---|---|---|
| 3,821,830 | 7/1974 | Sundheim | 15/353 |
| 3,942,217 | 3/1976 | Bates | 15/321 |
| 4,210,978 | 7/1980 | Johnson et al. | 15/320 |
| 4,333,202 | 6/1982 | Block | 15/353 |
| 4,956,891 | 9/1990 | Wulff | 15/320 |
| 5,319,828 | 6/1994 | Waldhauser et al. | 15/320 |

FOREIGN PATENT DOCUMENTS

| | | |
|---|---|---|
| 0 245 873 | 11/1987 | European Pat. Off. . |
| 0 726 057 | 8/1996 | European Pat. Off. . |
| 30 21 520 | 1/1982 | Germany . |
| 31 30 456 | 2/1983 | Germany . |
| 32 08 426 | 6/1984 | Germany . |
| 35 24 881 | 1/1987 | Germany . |

OTHER PUBLICATIONS

*Patent Abstracts of Japan,* Abstract of Japanese Patent, "Vacuum Motor Output Controller for Floor Surface Washing Car", Published Jun. 29, 1993 as Publication No. 05161582, Application No. 03329173.

*Primary Examiner*—Theresa T. Snider
*Attorney, Agent, or Firm*—Barry R. Lipsitz; Ralph F. Hoppin

[57] ABSTRACT

In order to construct a traveling floor cleaning appliance, which has a cleaning tool engaging on a floor surface, a cleaning liquid tank as well as a dirty liquid container and a suction unit for taking up a cleaning liquid sprayed on the floor surface and transferring it into the dirty liquid container, in such a manner that its design is simplified and its weight reduced it is suggested that the cleaning liquid tank be constructed as a one-piece, closed hollow body consisting of plastic and that the dirty liquid container be designed in the form of a double-walled receptacle of the hollow body.

19 Claims, 3 Drawing Sheets

TRAVELING FLOOR CLEANING APPLIANCE

This application is a continuation of international application No. PCT/EP97/05885, filed Oct. 24, 1997 pending.

BACKGROUND OF THE INVENTION

The present invention relates to a traveling floor cleaning appliance which comprises a cleaning tool engaging on a floor surface, a cleaning liquid tank as well as a dirty liquid container and a suction unit for taking up a cleaning liquid sprayed onto the floor surface and transferring this into the dirty liquid container.

Floor cleaning appliances of this type are used, in particular, as scrubbing machines, wherein one or more cleaning brushes are used as cleaning tool and these engage on the floor surface to be cleaned and clean it with the aid of the cleaning liquid. For this purpose, the cleaning liquid is sprayed on the floor surface in the region of the cleaning brushes and subsequently picked up again from the floor surface with loosened dirt due to the action of the suction unit and transferred into the dirty liquid container. In this respect, it is customary to mount the floor cleaning appliance on a mobile chassis which comprises a metal frame, for example, a tubular frame or a frame consisting of plate-like metal parts. The cleaning liquid tank is customarily designed as a separate container insertable into a housing of the floor cleaning appliance. German laid-open paper DE 30 21 520 A1 discloses a cleaning appliance, with which the housing has in the region of its vertical side walls and in the region of the floor chamber walls which extend parallel thereto and form closed chambers communicating with one another as receiving space for the cleaning liquid. The known cleaning appliance also comprises a dirt receiving space, into which a dirty liquid container can be inserted.

Constructions of this type entail a relatively heavy structure;

in addition, their production proves to be relatively complicated since various metal parts have to be connected to one another, for example, by way of welding or screws.

SUMMARY OF THE INVENTION

The object of the present invention is to construct a generic floor cleaning appliance in such a manner that its design is simplified and its weight reduced.

This object is accomplished in accordance with the invention, in a traveling floor cleaning appliance of the type specified at the outset, in that the cleaning liquid tank is constructed as a one-piece, closed hollow body consisting of plastic and that the dirty liquid container is designed in the form of a double-walled receptacle of t he hollow body.

In the case of the inventive construction, the cleaning liquid tank and the dirty liquid container are constructed together as a one-piece plastic member. The latter forms, on the one hand, the cleaning liquid tank in that the cleaning liquid, which is sprayed in the region of the cleaning tool for the purpose of cleaning the floor surface, can be filled into the hollow space of the plastic member; on the other hand, the plastic member comprises a double-walled receptacle, as a result of which the dirty liquid container is formed. This has a double wall and is therefore characterized by a particularly good noise dampening. Dirty liquid container and cleaning liquid tank may be produced in one operating step by suitable shaping of the one-piece, closed plastic hollow body. A separate dirty liquid container is not required.

In a particularly preferred embodiment, it is provided for the hollow body to be produced by the rotational sintering process or by the blowing process. These two production processes which are generally designated as hollow chamber processes make a particularly robust construction of the plastic hollow body possible. Whereas, as a rule, double-walled plastic housings are produced in that individual housing parts are each formed by the injection molding process and subsequently welded to one another in additional operating steps, structural parts produced by the hollow chamber process are produced in a single operating step. In this respect, plastics which are more impact-resistant can be used in comparison with the injection molding process and so particularly robust structural parts may be manufactured as a result.

During the production of the plastic hollow body by the rotational sintering process, powdered plastic material is filled into a hollow chamber tool and the tool is subsequently heated and caused to rotate in a rotation procedure. As a result of the ensuing centrifugal forces, a distribution of the plastic material on the housing walls is brought about, and the melting plastic material forms the walls of the hollow body structural part on the inner walls of the tool.

During the blowing process, hose-like plastic material is introduced into the hollow chamber tool through an opening. Subsequently, the plastic hose is blown up with hot air so that it fits onto the inner walls of the tool and thus the plastic hollow body results.

The hollow chamber tool required for the blowing process requires relatively high investment costs but the process has the advantage that the hollow bodies can be produced in the shortest time. In comparison thereto, the investment costs for the tool required for the rotational sintering process are less. The production procedure is, however, longer during the rotational sintering process than during the blowing process and it is therefore used, in particular, in the case of smaller numbers.

It is particularly advantageous when the one-piece, closed hollow body forms a chassis of the floor cleaning appliance.

With such a construction, no separate chassis is required as bearing structural part, on which the cleaning tool, a drive element driving the cleaning tool as well as the suction unit are held but rather the one-piece, closed plastic hollow body is used as bearing structural part, on which the functional parts of the floor cleaning appliance can be secured. The stability of the tank-like or container-like plastic hollow body can be increased by suitable shaping, for example, by way of ribs or beads so that a high stability can be achieved without a separate chassis being necessary for this. In this way, a one-piece structural part results which can be adapted in its shape to the given conditions and has a light weight despite a high stability. The chassis undertakes, on the one hand, the customary function of the holder for the functional parts, i.e., in particular, of the cleaning tool and the drive element; on the other hand, the chassis serves at the same time as cleaning liquid tank and as dirty liquid container. Special assembly work for assembling the chassis from individual parts is not necessary since the chassis is designed as a one-piece structural part.

It is favorable when passage-like entry and exit channels are formed in the hollow body, via which the dirty liquid container is in flow communication with a suction lip engaging on the floor surface and with the suction unit, respectively. During the production of the plastic hollow body, the entry and exit channels may be formed in it without a separate operating step being required for this.

It is of advantage when the entry channel is penetrated by a short entry connection pipe, the opening region of which is engaged over in the dirty liquid container by a separating wall designed, for example, in the shape of a dome. During operation of the floor cleaning appliance, the cleaning liquid can be sucked up from the floor surface together with loosened dirt and transferred into the dirty liquid container. This is brought about in that the dirty liquid container is acted upon by the suction unit with underpressure so that a dirty liquid-air mixture is sucked into the dirty liquid container via the suction lip. In order to maintain a reliable functioning of the suction unit it is of advantage when it is ensured that no dirty liquid can reach the suction unit but that this is, on the contrary, separated completely in the dirty liquid container. For this purpose, the opening region of the short entry connection pipe is engaged over by the separating wall so that the dirty liquid-air mixture entering the dirty liquid container impinges first of all on the separating wall, at which the dirty liquid is separated, while the air flows around the separating wall and is transferred into the suction unit.

In a structure which is particularly simple from a constructional point of view, it is provided for the separating wall to be arranged on a cover which covers the dirty liquid container. The cover thus forms an access to the interior of the dirty liquid container and so this can be emptied via the cover. At the same time, the cover forms a holder for the separating wall.

In a preferred development it is provided for the cover to be of a double-walled construction and have an inner cover and an outer cover and for the separating wall to be formed in the inner cover. The separating wall which is designed, for example, in the shape of a dome is thus connected to the inner cover in one piece, and the shape of the outer cover can be adapted to other given conditions without the construction of the separating wall needing to have any effect on its design. The shape of the outer cover is thus not bound to the construction of the separating wall.

In a particularly preferred development it is provided for the cover to be designed as a one-piece plastic body. This can be produced in an advantageous manner as a one-piece plastic hollow body by the hollow chamber process, i.e. by the rotational sintering or blowing process. This means that, on the one hand, the weight of the inventive floor cleaning appliance is additionally reduced and, on the other hand, a particularly simple structure from a constructional point of view results.

It is of advantage when the cover comprises a suction channel which is in flow communication with the interior of the dirty liquid container and with the suction unit. The cover thus forms part of the flow connection between the dirty liquid container and the suction unit. The suction channel can, for example, be molded in the cover designed in one-piece as a plastic body and be formed by suitable shaping of the cover.

For this purpose, it may, for example, be provided for the suction channel to extend in the region between inner and outer cover and to be in flow communication with the interior of the dirty liquid container via a suction opening arranged on the inner cover. The suction channel can thus be formed in the same operating step as the double-walled cover in that the intermediate space between the inner cover and the outer cover forms part of the flow connection between the inner cover of the dirty liquid container and the suction unit.

In order to connect the cover with the suction unit, a short outlet connection pipe penetrating the exit channel of the hollow body may be provided and this opens into the region between inner and outer cover. In this way, the interior of the dirty liquid container can be acted upon by the suction unit with underpressure via the suction opening, the double-walled cover and the short outlet connection pipe.

In order to avoid dirty liquid being able to reach the suction unit when the dirty liquid container is full, it is provided in a preferred development for the suction opening to be closable by means of a float valve when the dirty liquid container is full.

As already explained, it is advantageous when it is ensured during the operation of the floor cleaning appliance that as far as possible no dirty liquid reaches the suction unit. For this purpose, the dirty liquid-air mixture sucked into the dirty liquid container can be separated by means of the separating wall. In order to bring about a particularly effective separation, it is provided in a particularly preferred embodiment of the inventive floor cleaning appliance for a second separator to be arranged in the region between inner and outer cover. The second separator ensures that drops of dirty liquid entering the area between inner and outer cover are separated and returned to the dirty liquid container.

For this purpose, it may be provided for the second separator to be held on the inner cover in the region of the suction opening.

It is particularly favorable when the second separator is connected to the inner cover in one piece since this makes a particularly simple construction possible in that the second separator and the cover are formed together as a one-piece plastic body.

It is of advantage when the second separator comprises a short separator connection pipe dipping into the interior of the dirty liquid container, with an entry section which tapers conically in flow direction and opens into the suction opening and with at least one liquid return opening adjacent to the entry section. With such a construction, the air sucked out of the dirty liquid container and possibly taking along drops of dirty liquid, in addition, flows into the region between inner and out cover via the conically tapering entry section. After passing through the relatively narrow suction opening, the air sucked out experiences a considerable reduction in its flow velocity on account of the widening of the flow cross section and this results in a separation of any drops of liquid taken along which are returned to the dirty liquid container via the liquid return opening adjacent to the entry section.

In this way it is ensured that the suction unit is not loaded with dirty liquid. The susceptibility of the suction unit to any breakdown is thus considerably reduced.

Particularly preferably the second separator comprises several liquid return openings which surround the entry section.

The following description of one preferred embodiment of the invention serves to explain the invention in greater detail in conjunction with the drawings.

DETAILED DESCRIPTION OF THE INVENTION

Figure 1:
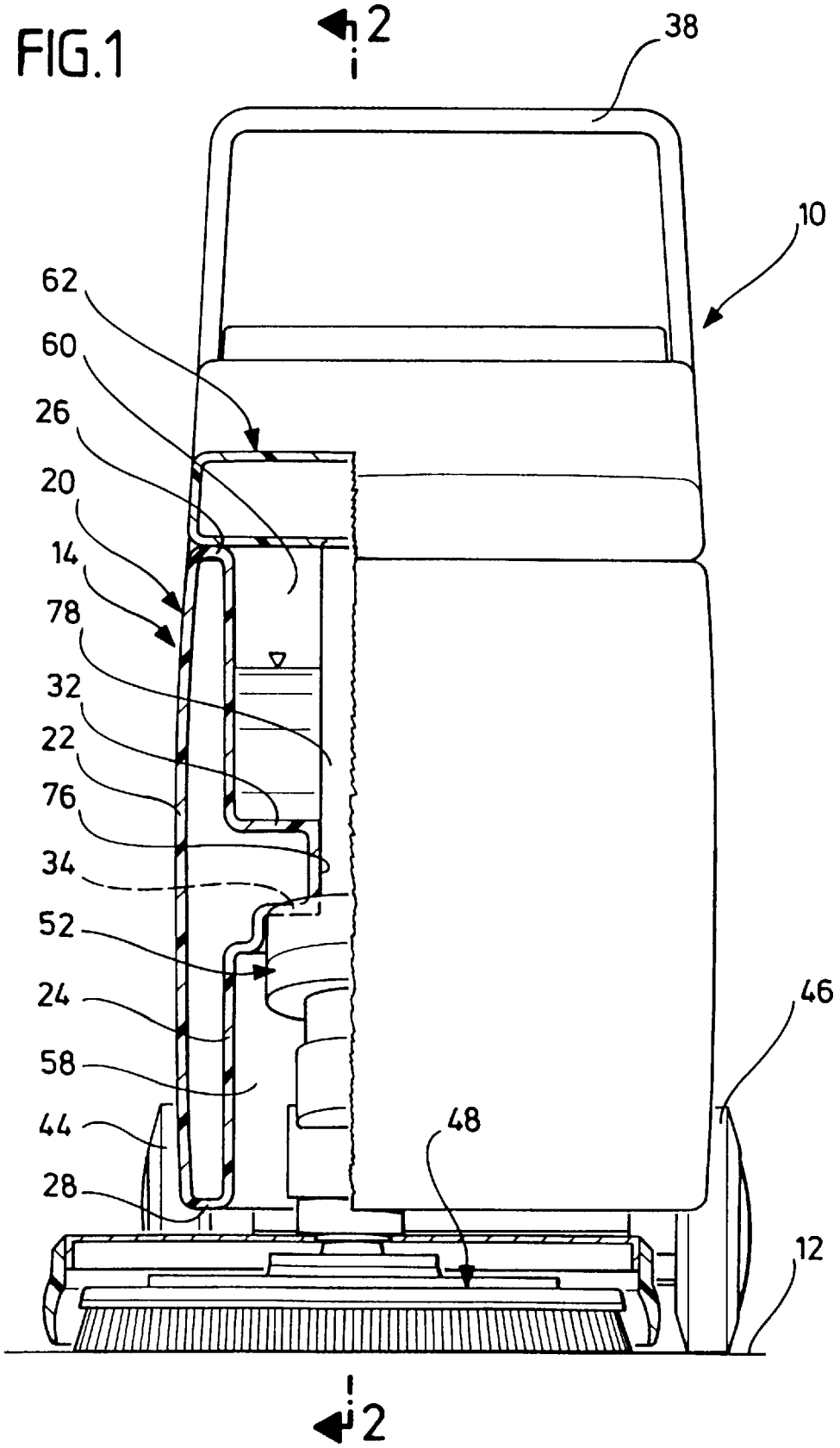
FIG. 1: a front view of a floor cleaning appliance partially broken open.
Figure 2:
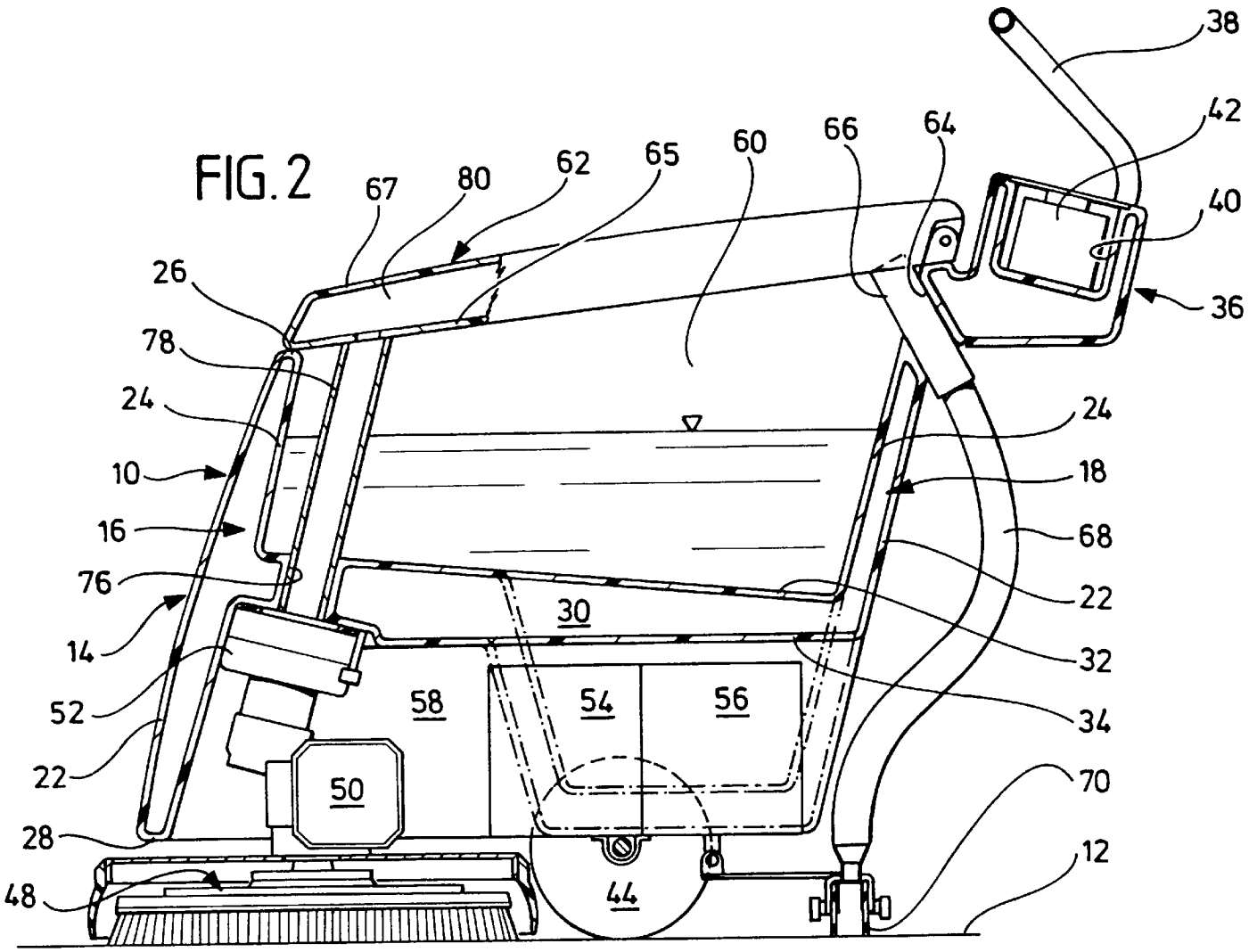
FIG. 2: a sectional view along the line 2—2 in FIG. 1.

In the drawings, a floor cleaning appliance provided altogether with the reference numeral 10 is illustrated for cleaning a floor surface 12. The floor cleaning appliance comprises a chassis in the form of a one-piece, closed hollow body 14 consisting of plastic which has an essentially H-shaped profile not only in longitudinal direction of the floor cleaning appliance—as illustrated in FIG. 2—but also transversely to the longitudinal direction of the floor cleaning appliance—illustrated in FIG. 1. The hollow body 14 comprises, in a front portion 16 and a rear portion 18 as well as in two side portions 20 which are arranged at a distance from one another and respectively connect the front portion 16 with the rear portion 18—of which only one side portion is illustrated in the drawings—, a respective outer wall 22 extending essentially vertically and a vertical inner wall 24 extending essentially parallel thereto, these walls being connected with one another via upper and lower intermediate walls 26 and 28.

The front portion 16 of the hollow body 14 is connected to the rear portion 18 via a central portion 30 extending essentially horizontally and centrally between the upper and lower intermediate walls 26 and 28. The central portion 30 also provides a connection between the two side portions of the hollow body 14. It is formed by an upper edge 32 extending approximately horizontally and a lower wall 34 extending practically parallel thereto.

The rear portion of the hollow body 14 extends as far as the upper end of the floor cleaning appliance 10 and there merges in one piece into a control desk 36 which is of a double-walled design, on which a steering handle 38 is held and which forms an essentially parallelepiped recess 40 for accommodating the control units 42 of the floor cleaning appliance 10.

The entire hollow body 14 represents a closed container which is designed as a molded part and produced by the rotational sintering or blowing process. The individual walls of the hollow body 14 are reinforced by suitable shaping which is not illustrated in the drawings, for example, by the formation of reinforcing ribs or by molded beads. The hollow body 14 extends over the entire length of the floor cleaning appliance and over its entire width and forms a stable frame or a stable structure for accommodating the individual functional parts of the floor cleaning appliance.

Such functional parts are, for example, wheels 44, 46 which are rotatably held in the region of the side portions 20 of the hollow body 14 at the lower intermediate wall 28 as well as a plate-like brush 48 which is arranged beneath the hollow body 14 and engages on the floor surface 12, is held for rotation about a vertical axis of rotation and driven by an electromotor 50 arranged above the plate-like brush 48. The electromotor 50 is, like a suction unit 52 as well as battery boxes 54 and 56, positioned in a drive chamber 58 beneath the central portion 30 which is limited in circumferential direction by the lower regions of the front portion 16 and the rear portion 18 as well as the side portions 20.

Above the central portion 30 the hollow body 14 forms an essentially parallelepiped receptacle or recess in the form of a dirty water container 60. The interior of the dirty water container 60 is accessible via a cover 62 which is held in the region of the control desk 36 so as to be pivotable about a horizontal axis and rests on the upper intermediate walls 26 so as to seal the interior of the dirty water container 60. Like the dirty water container 60, which has a double-walled design as a result of the inner walls 24 and the outer walls 22 of the side portions 20 as well as the front portion 14 and the rear portion 18 extending essentially parallel thereto and as a result of the upper and lower walls 32 and 34, respectively, of the central portion 30, the cover 62 is also of a double-walled design. It has an inner cover 65 and an outer cover 67.

A passage-like entry channel 64 is formed in the hollow body 14 in the region between the rear portion 18 and the control desk 36 and this channel is penetrated by a short entry connection pipe 66. The latter is in flow communication via a suction hose 68 with a suction lip 70, which engages on the floor surface 12 behind the plate-like brush 48 in the direction of travel of the floor cleaning appliance 10, and opens into the interior of the dirty water container 60. As is clear from FIGS. 3 and 4, the opening region 72 of the short entry connection pipe 66 facing away from the suction hose 68 is engaged over by a separating wall 74 which is designed in the shape of a dome and is formed in the inner cover 65.

In a region of the central portion 30 adjacent to the front portion 16, a passage-like exit channel 76 is formed in the hollow body 14 and this is penetrated by a short outlet connection pipe 78. This provides a flow connection between the suction unit 52 and a suction channel 80 which is limited by the inner cover 64 and the outer cover 66.

The suction channel 80 is in flow communication with the interior of the dirty water container 60 via a suction opening 82. The dirty water container 60 can thus be acted upon with underpressure by the suction unit via the suction opening 82, the suction channel 80 and the short outlet connection pipe 78 so that dirty liquid taken up from the floor surface 12 by means of the suction lip 70 is sucked into the dirty water container 60 together with air sucked in via the suction hose 68 and the short entry connection pipe 66. In this respect, a dirty water-air mixture flows through the short entry connection pipe 66, and the dirty water sucked in impinges on the separating wall 74 on account of its inertia and subsequently drips into the dirty water container 60. The air sucked in flows around the separating wall 74 and is sucked into the suction channel 80 and the short outlet connection pipe 78 via the suction opening 82. The opening region 72 thus forms in combination with the separating wall 74 surrounding it at a distance a separator which divides the dirty water-air mixture into its two component parts so that the dirty water, where possible, remains in the dirty water container 60 whereas the air is sucked away. In this way, dirty water is intended to be prevented from reaching the region of the suction channel 80 and from there passing into the suction unit 52 via the short outlet connection pipe 78 and so the functioning of the suction unit 52 is still ensured.

Figure 3:
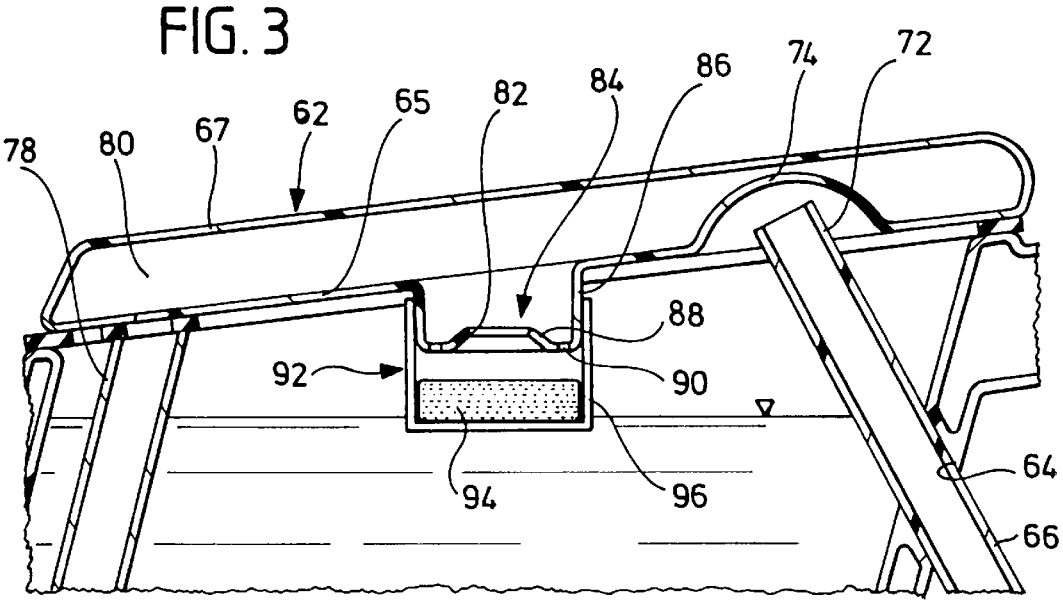
FIG. 3: an enlarged sectional view corresponding to FIG. 2 in the region of the cover with the dirty liquid container not yet filled
Figure 4:
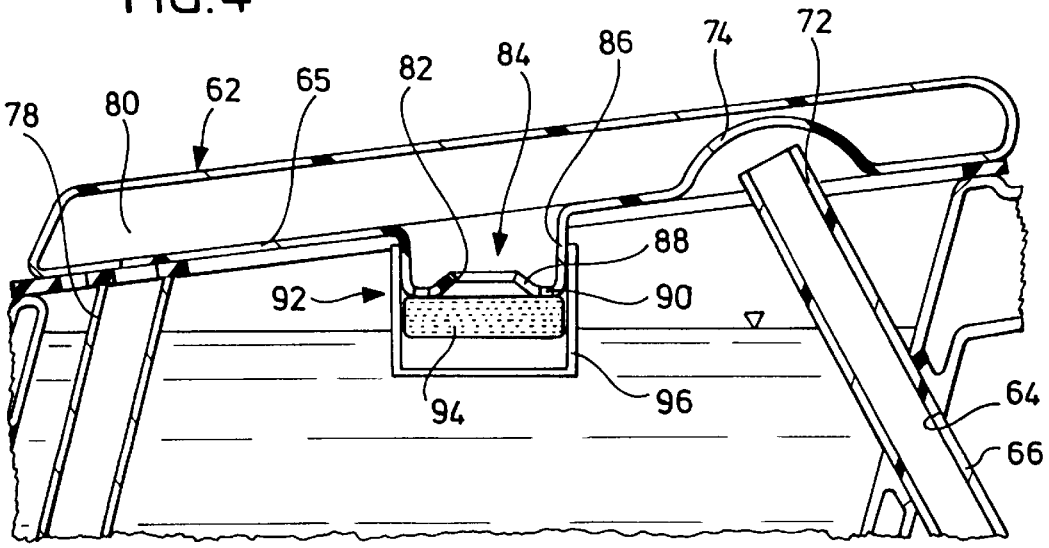
FIG. 4: an enlarged sectional view corresponding to FIG. 2 in the region of the cover with the dirty liquid container full.

However, it cannot be ruled out in all cases that the air flowing through the suction opening 82 will not carry along drops of dirty water into the region of the suction channel 80. In order to avoid these drops of dirty water which have been carried along from being able to pass into the suction unit 52, a second separator 84 illustrated in FIGS. 3 and 4 is arranged in the region of the suction opening 82. This separator comprises a short separator connection pipe 86 which proceeds from the inner cover 65 and dips into the interior of the dirty water container 60, is connected to the inner cover 64 in one piece and has at its end facing away from the inner cover 64 an entry section 88 tapering conically in flow direction of the air sucked out as well as liquid return openings 90 surrounding this section uniformly in circumferential direction. The conical entry section 88 opens into the suction opening 82 and results in an increase in the flow velocity for the air flowing into the suction channel 80 on account of the flow cross section decreasing continuously in flow direction. After passing through the suction opening 82, the air flowing through experiences an abrupt decrease in its flow velocity since the flow cross section now broadens suddenly. This, again, results in a separating effect for the drops of dirty water possibly carried along, i.e. the second separator 84 has, altogether, a cyclone-like mode of operation. Drops of dirty water separated in the region of the short separator connection pipe 86 can subsequently pass through the liquid return openings 90, which surround the suction opening 82 in circumferential direction, back into the inner area of the dirty water container 60.

The cover 62 of the floor cleaning appliance 10 thus has not only the function of forming a flow connection between the short suction connection pipe 78 and the interior of the dirty water container 60 but the cover 62 has, in addition, the second separator 84 and forms the separating wall 74 which, in combination with the opening region 72 of the short entry connection pipe 66, forms a main separator. Moreover, the cover 62 represents a double-walled closure of the dirty water container 60 which is completely closed in a double-walled manner by means of the cover 62 as well as the one-piece, closed hollow body 14. This double-walled construction of the dirty water container 60 also results in a strong dampening of the flow noises. Since, in addition, the electromotor 50 as well as the suction unit 52 are also surrounded by double walls in circumferential direction, the operation of the floor cleaning appliance 10 is well silenced and therefore very user-friendly.

The hollow body 14 produced by the rotational sintering or blowing process serves, on the one hand, as a bearing frame or chassis of the floor cleaning appliance 10; on the other hand, the hollow body 14 forms a cleaning liquid tank. Cleaning liquid can be sprayed onto the floor surface 12 to be cleaned from the hollow body 14 at the height of the plate-like brush 48 through openings not illustrated in the drawings. The floor surface 12 is subsequently cleaned due to the action of the plate-like brush 48 and the sprayed cleaning liquid is taken up again from the floor surface 12 by means of the suction lip 70 together with dirt particles and transferred into the dirty water container 60.

During operation of the floor cleaning appliance 10, the interior of the dirty water container 60 increasingly fills with dirty water so that the level of dirty water rises. In order to avoid the level of dirty water finally reaching the suction opening 82 and thus dirty water being able to pass to the suction unit via the suction channel 80 and the short suction connection pipe 78, a float valve 92 is arranged at the suction opening 82—as illustrated in FIGS. 3 and 4. This valve comprises a valve body in the form of a float 94 which is held for vertical displacement in a valve housing 96 which is placed on the short separator connection pipe 86. As long as the level of dirty water in the dirty water container 60 has not reached any critical height, the float 94 is held at a distance to the liquid return openings 90 and to the suction opening 82 on the second separator 84. This is illustrated in FIG. 3. When the dirty water container 60 is filled, the float 94 abuts sealingly on the short separator connection pipe 86 so that the flow connection between the interior of the dirty water container 60 and the suction unit 52 is interrupted. This is illustrated in FIG. 4. An additional sucking in of dirty liquid from the cleaned floor surface 12 is thus automatically interrupted when the dirty water container is full.

The electromotor 50 of the floor cleaning appliance 10 can be operated via storage batteries arranged in the battery boxes 54 and 56. In an alternative construction illustrated in FIG. 2 by dash-dot lines, it is provided for the electromotor 50 to be connected directly to a socket via a power cable not illustrated in the drawings. In this case, additional storage batteries and thus the battery boxes 54 and 56, as well, may be omitted. The space thereby resulting can be used for an extension of the dirty water container 60 as well as an increase in the volume of the hollow body 14 and thus also of the cleaning agent tank. For this purpose, the region of the central portion 30 adjacent to the rear portion 18—as illustrated by dash-dot lines in FIG. 2—can be drawn downwards as far as the level of the axis of rotation of the wheels 44 and 46. The mains-powered version thus differs from the battery version of the floor cleaning appliance 10 essentially only due to the shape of the hollow body 14. Since this is produced by the rotational sintering or blowing process, its shape can be varied by way of a simple insert in the hollow chamber tool. Thus, no complicated tool changes are required in order to produce a mains-powered version of the floor cleaning appliance 10 instead of a battery version.

What is claimed is:

1. A traveling floor cleaning appliance comprising:

a cleaning tool adapted to engage a floor surface, a cleaning liquid tank adapted to hold cleaning liquid to be applied onto the floor surface, a dirty liquid container; and a suction unit for taking up cleaning liquid applied to the floor surface from said cleaning tank and transferring said cleaning liquid from said floor surface into the dirty liquid container, wherein:

the cleaning liquid tank is constructed as a one-piece, plastic enclosed hollow body, and the dirty liquid container comprises a double-walled receptacle formed by said hollow body and a cover, wherein the cover comprises a suction channel in flow communication with the interior of the dirty liquid container and with the suction unit.

2. A floor cleaning appliance as defined in claim 1, wherein said hollow body comprises a rotationally sintered body.

3. A floor cleaning appliance as defined in claim 1, wherein said hollow body comprises a blown body.

4. A traveling floor cleaning appliance comprising:

a cleaning tool adapted to engage a floor surface, a cleaning liquid tank adapted to hold cleaning liquid to be applied onto the floor surface, a dirty liquid container, and a suction unit for taking up cleaning liquid applied to the floor surface from said cleaning tank and transferring said cleaning liquid from said floor surface into the dirty liquid container, wherein;

the cleaning liquid tank is constructed as a one-piece, plastic enclosed hollow body which forms a chassis of the floor cleaning appliance, and the dirty liquid container comprises a double-walled receptacle formed by said hollow body.

5. A traveling floor cleaning appliance comprising:

a cleaning tool adapted to engage a floor surface;

a cleaning liquid tank adapted to hold cleaning liquid to be applied onto the floor surface;

a dirty liquid container;

a suction unit for taking up cleaning liquid applied to the floor surface from said cleaning tank and transferring said cleaning liquid from said floor surface into the dirty liquid container, wherein the cleaning liquid tank is constructed as a one-piece, plastic enclosed hollow body, and the dirty liquid container comprises a double-walled receptacle formed by said hollow body;

passage-like entry and exit channels formed in said hollow body, and a suction lip adapted to engage on the floor surface for application of the suction produced by the suction unit, said dirty liquid container being in flow connection with said suction lip and with the suction unit, respectively, via said channels.

6. A floor cleaning appliance as defined in claim 5, wherein:

the entry channel is penetrated by a short entry connection pipe, and a separator in the form of a separating wall is provided over an opening region of said connection pipe in the dirty liquid container.

7. A floor cleaning appliance as defined in claim 6, wherein the separating wall is provided on a cover covering the dirty liquid container.

8. A floor cleaning appliance as defined in claim 7, wherein:

the cover is of a double-walled construction which forms an inner cover and an outer cover, and the separating wall is formed in the inner cover.

9. A floor cleaning appliance as defined in claim 8, wherein the cover comprises a one-piece plastic body.

10. A floor cleaning appliance as defined in claim 9, wherein a second separator is arranged in a region between the inner and outer cover.

11. A floor cleaning appliance as defined in claim 8, wherein the cover comprises a suction channel in flow communication with the interior of the dirty liquid container and with the suction unit.

12. A floor cleaning appliance as defined in claim 11, wherein the suction channel extends in a region between the inner and outer cover and is in flow communication with the interior of the dirty liquid container via a suction opening arranged on the inner cover.

13. A floor cleaning appliance as defined in claim 12, further comprising a float valve for closing the suction opening when the dirty liquid container is full.

14. A floor cleaning appliance as defined in claim 8, wherein a second separator is arranged in a region between the inner and outer cover.

15. A floor cleaning appliance as defined in claim 14, wherein the second separator is held on the inner cover in a region of the suction opening.

16. A floor cleaning appliance as defined in claim 15, wherein the second separator is connected to the inner cover in one piece.

17. A floor cleaning appliance as defined in claim 15, wherein the second separator comprises:

a short separator connection pipe extending into the interior of the dirty liquid container, an entry section tapering conically in a flow direction and opening into the suction opening, and at least one liquid return opening adjacent to the entry section.

18. A floor cleaning appliance as defined in claim 7, wherein the cover comprises a one-piece plastic body.

19. A floor cleaning appliance as defined in claim 7, wherein the cover comprises a suction channel in flow communication with the interior of the dirty liquid container and with the suction unit.

* * * * *